US012691318B2

(12) United States Patent
Chen et al.

(10) Patent No.: US 12,691,318 B2
(45) Date of Patent: Jul. 28, 2026

(54) SAFE AND RELIABLE TRAMPOLINE

(71) Applicant: BESTWAY INFLATABLES & MATERIAL CORP., Shanghai (CN)

(72) Inventors: Xiaobo Chen, Jinhua City (CN); Fengwang Chen, Jinhua City (CN); Yanping Wu, Jinhua City (CN); Chunqi Jiang, Jinhua City (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 103 days.

(21) Appl. No.: 18/926,403

(22) Filed: Oct. 25, 2024

(65) Prior Publication Data

US 2025/0135257 A1 May 1, 2025

(30) Foreign Application Priority Data

Oct. 27, 2023 (CN) ..... 202322898274.4

(51) Int. Cl.

| | |
|---|---|
| ***A63B 5/11*** | (2006.01) |
| ***A63B 21/00*** | (2006.01) |
| ***A63B 71/00*** | (2006.01) |
| ***A63B 71/02*** | (2006.01) |

(52) U.S. Cl.

CPC ..... *A63B 5/11* (2013.01); *A63B 21/4035* (2015.10); *A63B 71/023* (2013.01); *A63B 2071/009* (2013.01); *A63B 2210/50* (2013.01)

(58) Field of Classification Search

CPC ... A63B 5/11; A63B 21/4034; A63B 21/4035; A63B 22/0046; A63B 71/0054; A63B 71/023; A63B 2071/0072; A63B 2071/009; A63B 2210/00; A63B 2210/50; A63B 2225/05; A63B 2225/09; A63B 2225/093

See application file for complete search history.

(56) References Cited

U.S. PATENT DOCUMENTS 5,370,591 A * 12/1994 Jewell ..... A63B 5/08 482/30
5,545,110 A * 8/1996 Hsiang ..... A63B 5/11 482/28
6,648,799 B2 * 11/2003 Hall ..... A63B 5/11 482/28

(Continued)

FOREIGN PATENT DOCUMENTS

AU 2003101039 A4 * 2/2004
CN 201208469 Y * 3/2006

(Continued)

OTHER PUBLICATIONS

Extended European Search Report dated Mar. 3, 2025 (Mar. 3, 2025), 10 pages, issued on related European Patent Application 24208413.5 by the European Patent Office.

*Primary Examiner* — Gary D Urbiel Goldner
(74) *Attorney, Agent, or Firm* — Dickinson Wright PLLC

(57) ABSTRACT

A trampoline includes a trampoline frame and a bounce cloth. A plurality of bands are connected at circumferential intervals between the bounce cloth and the trampoline frame, an enclosing cloth is integrally sewn at an edge of the bounce cloth and covers the plurality of bands, an outer edge of the enclosing cloth is folded down and wrapped around a periphery of the trampoline frame, and a handlebar is mounted on the trampoline frame.

7 Claims, 5 Drawing Sheets

(56) References Cited

U.S. PATENT DOCUMENTS

| | | | | |
|---|---|---|---|---|
| 7,468,020 | B2 * | 12/2008 | Lai | A63B 5/11 482/28 |
| 8,047,967 | B1 * | 11/2011 | Teng | A63B 5/11 482/28 |
| D936,777 | S * | 11/2021 | Ren | D12/178 |
| D944,338 | S | 2/2022 | Li et al. | |
| 2001/0000250 | A1 * | 4/2001 | Steger | A63B 5/11 482/27 |
| 2005/0130804 | A1 | 6/2005 | Hall | |
| 2005/0137061 | A1 * | 6/2005 | Wang | A63B 5/11 482/28 |
| 2007/0072738 | A1 * | 3/2007 | Lai | A63B 5/11 482/28 |
| 2008/0090704 | A1 * | 4/2008 | Denis | A63B 5/11 482/28 |
| 2014/0287880 | A1 * | 9/2014 | Publicover | F16C 11/04 482/28 |
| 2017/0232288 | A1 | 8/2017 | Ho et al. | |
| 2017/0239504 | A1 * | 8/2017 | Chen | A63B 71/022 |
| 2021/0244990 | A1 | 8/2021 | Srihari et al. | |
| 2022/0305319 | A1 * | 9/2022 | Greenberg | A63B 71/0622 |
| 2024/0198159 | A1 * | 6/2024 | Chen | A63B 5/11 |
| 2024/0325852 | A1 * | 10/2024 | Chen | A63B 5/11 |
| 2024/0366986 | A1 * | 11/2024 | Sun | A63B 5/11 |

FOREIGN PATENT DOCUMENTS

| | | | | |
|---|---|---|---|---|
| CN | 208641629 | U * | 3/2019 | |
| CN | 110711340 | A * | 1/2020 | A63B 5/11 |
| CN | 210543064 | | 5/2020 | |
| CN | 213374918 | U * | 6/2021 | |
| CN | 113209544 | A * | 8/2021 | A63B 5/11 |
| CN | 218474829 | | 2/2023 | |
| CN | 218474830 | | 2/2023 | |
| CN | 116966473 | A * | 10/2023 | A63B 5/11 |
| DE | 20110464 | U1 * | 9/2001 | A63B 5/11 |
| FR | 2827782 | A3 * | 1/2003 | A63B 5/11 |
| KR | 20200020165 | A * | 2/2020 | A63B 5/11 |
| KR | 102091932 | B1 * | 3/2020 | A63B 5/11 |
| TW | M549644 | U * | 10/2017 | |

* cited by examiner

SAFE AND RELIABLE TRAMPOLINE

CROSS-REFERENCE TO RELATED APPLICATIONS

This application claims the benefit of Chinese Utility Model No. 202322898274.4, filed Oct. 27, 2023, the entire contents of which are hereby incorporated by reference in their entirety.

TECHNICAL FIELD

The present disclosure relates to a recreational apparatus, and more particularly, to a safe and reliable trampoline.

BACKGROUND

Trampolines are common recreational apparatuses. In order to adapt to the use of children, the elastic expansion and contraction of many small trampolines are realized by springs, elastic ropes and elastic bands. However, due to the strong rigidity of springs, elastic ropes, and elastic bands, traditional trampolines may cause damage to a child if the child bounces for an extended period of time. For example, in trampolines which utilize elastic ropes, bouncing for an extended time may cause the elastic ropes to fail, which may minimize the effectiveness of the trampoline and increase the risk of injury. Furthermore, elastic bands and other similar bouncing mechanisms may trap the foot of the child in the elastic band when the child bounces, resulting in a risk of injury due to foot trapping. Moreover, the traditional small trampolines for children have no handlebars, which may create additional safety hazards.

SUMMARY

In order to overcome the above shortcomings, the present disclosure provides a safe and reliable trampoline that utilizes a bouncing mechanism which is less prone to foot trapping and minimizes other safety concerns described herein.

In particular, the trampoline described herein includes a trampoline frame and a bounce cloth, wherein a plurality of bands are connected at circumferential intervals between the bounce cloth and the trampoline frame, an enclosing cloth integrally sewn at an edge of the bounce cloth and covering the plurality of bands, wherein an outer edge of the enclosing cloth is folded down and wrapped around a periphery of the trampoline frame. In one aspect, a handlebar is mounted on the trampoline frame.

There is no gap between the enclosing cloth and the bounce cloth after they are sewn integrally, which alleviates the risk of foot trapping during use of a trampoline. An elastic connection is realized between the bounce cloth and the trampoline frame by means of the plurality of bands, which have soft elasticity, and would not cause harm to a child's body even if the child bounces for a long time. The outer edge of the enclosing cloth is folded down and wrapped around the periphery of the trampoline frame, which creates a reliable connection between the enclosing cloth and the trampoline frame, and also wraps the periphery of the trampoline frame, making it difficult for hands and feet of children to touch various joint positions of the trampoline frame. Accordingly, the potential safety hazards are reduced and the overall aesthetics of the trampoline frame are also improved. The handlebar is installed on the trampoline frame and can be grasped in the process of bouncing to keep the body stable.

In some embodiments, the handlebar is of an inverted U-shaped structure, and is connected to the trampoline frame at a first end and a second end of the handlebar.

In some embodiments, the handlebar comprises a plurality of stand rods including at least a first stand rod and a second stand rod, and a lateral rod is connected between the first stand rod and the second stand rod, and the lateral rod is of an arc-shaped structure.

It should be appreciated that, in these embodiments, the arc-shaped lateral rod may be more comfortable for a user to hold, and the connection of the lateral rod to the plurality of stand rods may be convenient for assembly.

In some embodiments, an upper end of each of the first stand rod and the second stand rod is bent to form a connection section, and the first end of the lateral rod and the second end of the lateral rod are connected to the connection sections on the first stand rod and the second stand rod in an inserted manner and are locked in position via spring button clips.

In these embodiments, the plurality of stand rods are vertically arranged, while the lateral rod is transversely arranged, and the connection section is formed by bending an end of the plurality of stand rods. It should be appreciated that this configuration may be convenient for the connection of the plurality of stand rods and the lateral rod. For example, after being connected in an inserted manner, the lateral rod and the plurality of stand rods are locked and fixed in position by the spring button clips, such that the lateral rod has a small swinging clearance and is safe to use.

In some embodiments, the trampoline frame comprises a plurality of base pipes sequentially hinged end to end to form a foldable structure having a circular shape or polygonal shape. In one aspect, the base pipes are arc shaped.

The trampoline frame comprises a plurality of leg pipes, and upper ends of the leg pipes are detachably connected to the plurality of base pipes.

It should be appreciated that, when the trampoline is not in use, the trampoline frame can be folded, thereby reducing the storage space and facilitating carrying. Furthermore, when the trampoline is folded, the leg pipes may be detached from the plurality of base pipes, and then the plurality of base pipes may be rotated for folding and storage.

In some embodiments, a hinge structure is arranged at a hinged portion of two adjacent base pipes of the plurality of base pipes, the hinge structure comprises a hinge seat and a hinge lug, the hinge seat and the hinge lug are hingedly coupled via a hinge shaft, and the hinge seat is provided with a limiting recess, and after the plurality of base pipes are unfolded, at least one of the plurality of base pipes to which the hinge lug is connected, is clamped in the limiting recess.

In some embodiments, a first hinge seat and a second hinge seat are installed at each end of a subset of the plurality of base pipes, such that an opening of the first hinge seat faces inward of the trampoline frame and an opening of the second hinge seat faces downward. Consequently, a first hinge lug and a second hinge lug are installed at each end of another subset of the plurality of base pipes, such that an opening of the first hinge lug faces inward and an opening of the second hinge lug faces downward. The hinge seat facing inwardly is coupled to the hinge lug facing inwardly, so as the hinge seat facing downwardly is coupled to the hinge lug facing downwardly.

It should be appreciated that the plurality of base pipes are rotatably coupled relative to each other by means of the hinge structure, such that the connection between the plurality of base pipes is convenient and reliable, and unfolding and folding the plurality of base pipes is convenient. After the plurality of base pipes are unfolded, the at least one of the plurality of base pipes to which the hinge lug is connected is clamped in the limiting recess thereby ensuring the stability of the trampoline frame.

In some embodiments, a clamping groove is provided in the hinge lug, a spring pin is installed on the hinge seat, and, after the plurality of base pipes are folded, the spring pin is clamped in the clamping groove to lock the plurality of base pipes in position. In one aspect, the spring pin is U-shaped.

It should be appreciated that, after the plurality of base pipes are folded, the spring pin is clamped in the clamping groove to lock the plurality of base pipes in position, thereby preventing potential safety hazards caused by the plurality of base pipes popping out of position.

In some embodiments, a rope is connected to the outer edge of the enclosing cloth, notches are provided on an edge of the enclosing cloth at positions corresponding to the leg pipes, connecting loops are formed between the notches and the rope, and the connecting loops are connected with the leg pipes. In one aspect, the rope is elastic.

It should be appreciated that the connecting loops formed between the rope and the notches allow for the connection with the leg pipes, such that the edge of the enclosing cloth is wrapped around the trampoline frame.

In some embodiments, leg rests are installed at lower ends of the leg pipes, and non-slip pads are arranged at the bottoms of the leg rests.

In these embodiments, it should be appreciated that the non-slip pads, enhance the stability of leg pipe, such that support of the trampoline can be improved.

In some embodiments, suction leg rests are installed at lower ends of the leg pipes, suction cups are arranged at the bottoms of the suction leg rests, and an outwardly projecting puller is arranged at an edge of each of the suction cups.

In these embodiments, the suction cup is provided on the suction leg rest. When the leg pipe is used to provide additional support to the trampoline, the suction cup adheres to the ground via negative pressure to provide a stable support of the leg pipe, and when the leg pipe is to be moved, the puller is pulled upwardly to allow the separation of the suction cup from the ground, such that the leg pipe can be easily moved.

In other embodiments, a trampoline is disclosed. The trampoline includes a trampoline frame having a plurality of base pipes, a bounce cloth extending across the trampoline frame, a plurality of bands circumferentially connected at intervals between the bounce cloth and the trampoline frame, an enclosing cloth sewn at an edge of the bounce cloth such that the enclosing cloth covers the plurality of bands, a handlebar mounted on the trampoline frame, and a hinged structure coupled between each of the plurality of base pipes. The plurality of base pipes are movable between a folded position and an unfolded position via the hinged structure.

In some embodiments, the handlebar is of an inverted U-shaped structure, and is connected to the trampoline frame at a first end and a second end of the handlebar.

In some embodiments, the handlebar comprises a plurality of stand rods including at least a first stand rod and a second stand rod, and a lateral rod connected between the first stand rod and the second stand rod.

In some embodiments, the trampoline frame further comprises a plurality of handlebar sleeves, each of them corresponding to one of the plurality of stand rods, so that lower ends of the plurality of stand rods may be inserted into the plurality of handlebar sleeves.

In some embodiments, the trampoline frame further a plurality of leg pipes, and upper ends of the plurality of leg pipes are detachably connected to the plurality of base pipes.

In some embodiments, the hinge structure comprises a hinge seat and a hinge lug, the hinge seat and the hinge lug being hingedly coupled via a hinge shaft.

In some embodiments, the hinge seat is provided with a limiting recess, and after the plurality of base pipes are moved to the unfolded position, the at least one of the plurality of base pipes to which the hinge lug is connected is clamped in the limiting recess.

In some embodiments, a clamping groove is provided in the hinge lug, a spring pin is installed on the hinge seat, and after the plurality of base pipes are moved to the folded position, and the spring pin is clamped in the clamping groove to lock the plurality of base pipes in the folded position.

In some embodiments, a rope is connected to the enclosing cloth, notches are provided on the enclosing cloth at positions corresponding to the plurality of leg pipes, connecting loops are formed between the notches and the rope, and the connecting loops are connected to the plurality of leg pipes. In one aspect, the loop is in the form of a noose or sliding knot.

In some embodiments, a plurality of leg rests are installed at lower ends of each of the plurality of leg pipes, and non-slip pads are arranged on each of the plurality of leg rests.

In yet another embodiment of the present disclosure, a trampoline is disclosed. The trampoline includes a trampoline frame having a plurality of leg pipes and plurality of base pipes that are hingedly connected and foldable between a folded state and an unfolded state, at least one suction leg rest installed on each of the plurality of leg pipes, at least one suction cup installed on the at least one suction leg rest, a bounce cloth extending across the trampoline frame, a plurality of bands circumferentially connected at intervals between the bounce cloth and the trampoline frame, an enclosing cloth sewn at an edge of the bounce cloth such that the enclosing cloth covers the plurality of bands. In one aspect, an outer edge of the enclosing cloth covers a periphery of the trampoline frame.

In view of the foregoing, it should be appreciated that the trampoline described herein is safe and reliable to use, and is less prone to foot trapping. Furthermore, the handlebar has a small swinging clearance that is safe to use, and the trampoline frame can be folded to facilitate storage and carrying. In these embodiments, after the trampoline frame is folded, the spring pin installed on the hinge seat may be clamped in the clamping groove in the hinge lug to lock the plurality of base pipes in the folded position, thereby preventing potential safety hazards caused by the plurality of base pipes coming loose from the folded position. Finally, it should be understood that the support at the bottom of the leg pipe is stable and reliable, which ensures the stability of the trampoline frame.

BRIEF DESCRIPTION OF THE DRAWINGS

Other features and advantages of the present disclosure will be understood from the following embodiments described in detail herein and with reference to the accompanying drawings, in which like reference numerals represent the same or similar components.

Figure 1:
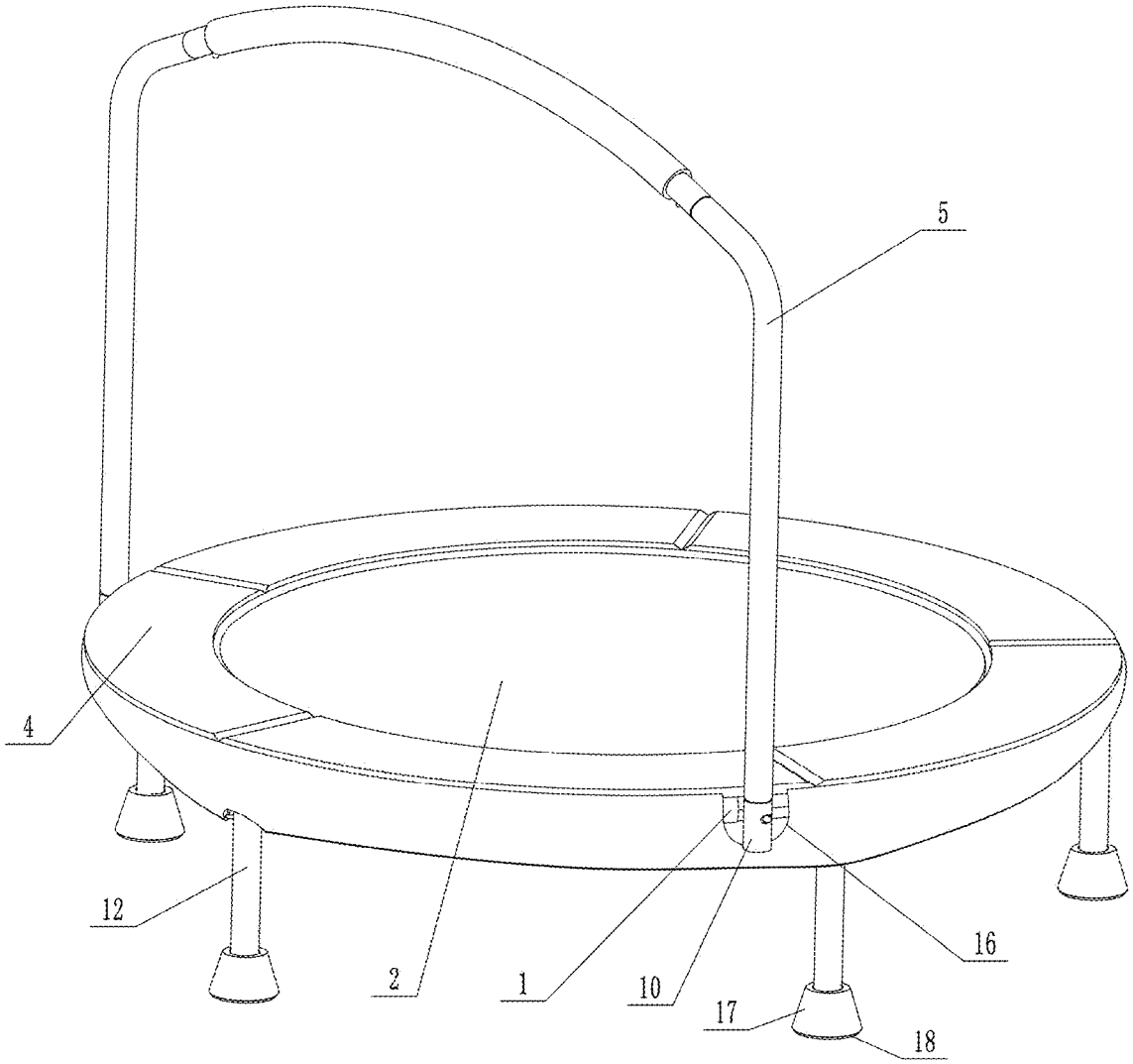
FIG. 1 is a schematic diagram of a trampoline, according to one or more embodiments shown and described herein.

Elements in the figures are shown for simplicity and clarity and are not necessarily drawn to exact scale. It can be understood that these accompanying drawings are not only intended to explain and illustrate the present disclosure and description, but also contribute to the scope of the present disclosure.

DETAILED DESCRIPTION

The implementation and application of embodiments of a trampoline will be discussed in detail below. However, it should be understood that the embodiments discussed and illustrated herein illustratively described various embodiments, implementations, and applications of the present disclosure, and are not intended to limit the scope of the present disclosure.

Referring now to FIGS. 1-4, a trampoline is depicted. In these embodiments, the trampoline may include a trampoline frame 1 and a bounce cloth 2. A plurality of elastic bands 3 may be circumferentially connected at intervals between the bounce cloth 2 and the trampoline frame 1. Furthermore, an enclosing cloth 4 may be integrally sewn at an edge of the bounce cloth 2 and covers the elastic bands 3. An outer edge of the enclosing cloth 4 may be folded down and wrapped around a periphery of the trampoline frame 1. In these embodiments, the elastic bands 3 may be wide bands (e.g., having a greater surface area compared to other thin cords or narrow straps), such that the elastic bands 3 are configured to provide enhanced load distribution when the trampoline is in use. For example, in these embodiments, the elastic bands 3 may reduce stress points on both the trampoline frame 1 and the bounce cloth 2, which may allow for the connection to remain stable and durable over time. Furthermore, it should be appreciated that the elastic bands 3 may provide increased resistance to wear and tear, and may also offer improved safety, as the likelihood of a user getting a foot, hand, or other appendage caught in the elastic bands 3 is minimized as the width of the elastic bands 3 is increased.

Although the trampoline depicted in FIGS. 1-4 is illustrated as utilizing elastic bands connected between the trampoline frame 1 and the bounce cloth 2, in some embodiments, the trampoline may include a plurality of springs, such as elastic springs. In these embodiments, the plurality of springs may be configured with a controlled tension to provide a softer bounce for users and minimize the risk of injury. Furthermore, the enhanced durability offered by the plurality of springs may allow for extended use of the trampoline without the need for frequent replacement of elastic components. To further enhance the safety, in the embodiments described herein, the plurality of springs may further include a protective sleeve coated on and/or disposed about each of the plurality of springs, with the protective sleeve being configured to prevent pinching and/or other contact with the user during operation of the trampoline.

Furthermore, in the embodiments described herein, it should be appreciated that the enclosing cloth 4 may further include a safety net. For example, in these embodiments, a safety net may be integrally formed with and/or detachably connected to the enclosing cloth 4, with the safety net extending in a vertical direction about the periphery of the trampoline frame 1. The safety net may prevent a user from inadvertently bouncing off the trampoline or contacting the handlebar 5 while the trampoline is in use. In the embodiments in which the safety net is detachably connected to the enclosing cloth 4, detaching the safety net from the enclosing cloth 4 may aid in compacting the size of the trampoline for storage and transport purposes.

Referring still to FIGS. 1-4, a handlebar 5 may be mounted on the trampoline frame 1 and may be in the shape of an inverted U-shaped structure. In these embodiments, the handlebar 5 may be connected to the trampoline frame 1 at two ends (e.g., a first end and a second end of the handlebar 5). The handlebar 5 may include a plurality of stand rods 6, such as at least a first stand rod and a second stand rod (e.g., at least two stand rods), and a lateral rod 7, also referred to as lateral rod 7, may be connected between the two stand rods 6. As illustrated in FIGS. 1-4, the lateral rod 7 may have an arc-shaped structure. The first end and second end of the handlebar 5 may be defined by the lower ends of the stand rods 6.

Referring still to FIGS. 1-4, a protective tube 8 may be disposed on and/or about the lateral rod 7. In these embodiments, the protective tube 8 may be a sleeve, or any other similar component configured to be disposed about the lateral rod 7. For example, the protective tube 8 may be formed of a material configured to improve user safety and comfort while also protecting the structure of the handlebar 5, such as foam rubber, silicone rubber, polyvinyl chloride (PVC), thermoplastic elastomer, neoprene, or any other similar material.

In these embodiments, an upper end of each of the plurality of stand rods 6 may be bent to form a connection section 9, and two ends of the lateral rod 7 (e.g., first lateral end and second lateral end) are respectively connected to the connection section 9 on the each of the plurality of stand rods 6 in an inserted manner and are locked and fixed by means of spring button clips. In these embodiments, an end portion of the connection section 9 may be necked to facilitate the insertion and positioning within each of the first lateral end and the second lateral end of the lateral rod 7. As provided herein, the term "necked" may refer to a portion of the connection section 9 having a reduced diameter, such that the connection section 9 may be received within the first lateral end and second lateral end, respectively. It will be appreciated that the ends of the lateral rod 7 may also be necked and received within the respective ends of the connection sections 9 of the stand rods 6.

As further illustrated in FIGS. 1-4, the trampoline frame 1 may also be provided with a plurality of handlebar sleeves 10, with each of the plurality of handlebar sleeves 10 corresponding to one of the plurality of stand rods 6. In these embodiments, and as most clearly depicted in FIG. 2, lower ends of the plurality of stand rods 6 may be inserted into the plurality of handlebar sleeves 10 and may be locked within the plurality of handlebar sleeves 10 by way of screws or any other similar fastening mechanism.

In some embodiments, it should be further appreciated that each of the plurality of stand rods 6 may be extendable, such that a height of the handlebar 5 (e.g., relative the trampoline frame) may be adjusted. For example, although not depicted, each of the plurality of stand rods 6 may include a plurality of telescoping members, which may be extended and/or retracted relative one another to adjust the height of the handlebar 5, as is described herein. In these embodiments, the adjustable height of the handlebar 5 may allow the trampoline to accommodate users of various heights, or to accommodate a single user (e.g., child) as the user grows. Furthermore, by adjusting the handlebar 5 to accommodate a particular height of a user, it may be possible to ensure that the trampoline remains stable during use. In another aspect, stand rod extensions, being generally straight, may be attached between the bottom ends of the stand rods 6 and the handlebar sleeves 10.

Furthermore, in the embodiments described herein, it should be appreciated that the trampoline frame 1 may include multiple handlebars 5. For example, in some embodiments, the trampoline frame 1 may include a plurality of handlebars 5 positioned about the trampoline frame 1. In these embodiments, the plurality of handlebars 5 may allow for multi-user functionality in which several children (or other users) are able to utilize the trampoline simultaneously. Additionally, the additional handlebars 5 may allow the user to change their position or orientation.

Referring still to FIGS. 1-4, the trampoline frame 1 may further include a plurality of base pipes 11, such as arc-shaped pipes, and a plurality of leg pipes 12. In these embodiments, the elastic bands 3 may be connected to the plurality of base pipes 11, and upper ends of the leg pipes 12 may be detachably connected to the plurality of base pipes 11. The plurality of base pipes 11 may be sequentially hinged end to end (e.g., along a length of each of the plurality of base pipes 11 from a first pipe end to a second pipe end of each of the plurality of base pipes 11) to form a foldable structure, such as a circular structure or any other similarly shaped structure. In this embodiment, the plurality of base pipes 11 may include at least a first arc-shaped pipe and a second arc-shaped pipe, and each of the plurality of base pipes 11 may be connected to at least one leg pipe 12. In another aspect the arc-shape of the base pipe 11 may be defined by a polygonal bent shape having one or more bends between straight sections.

Figure 2:
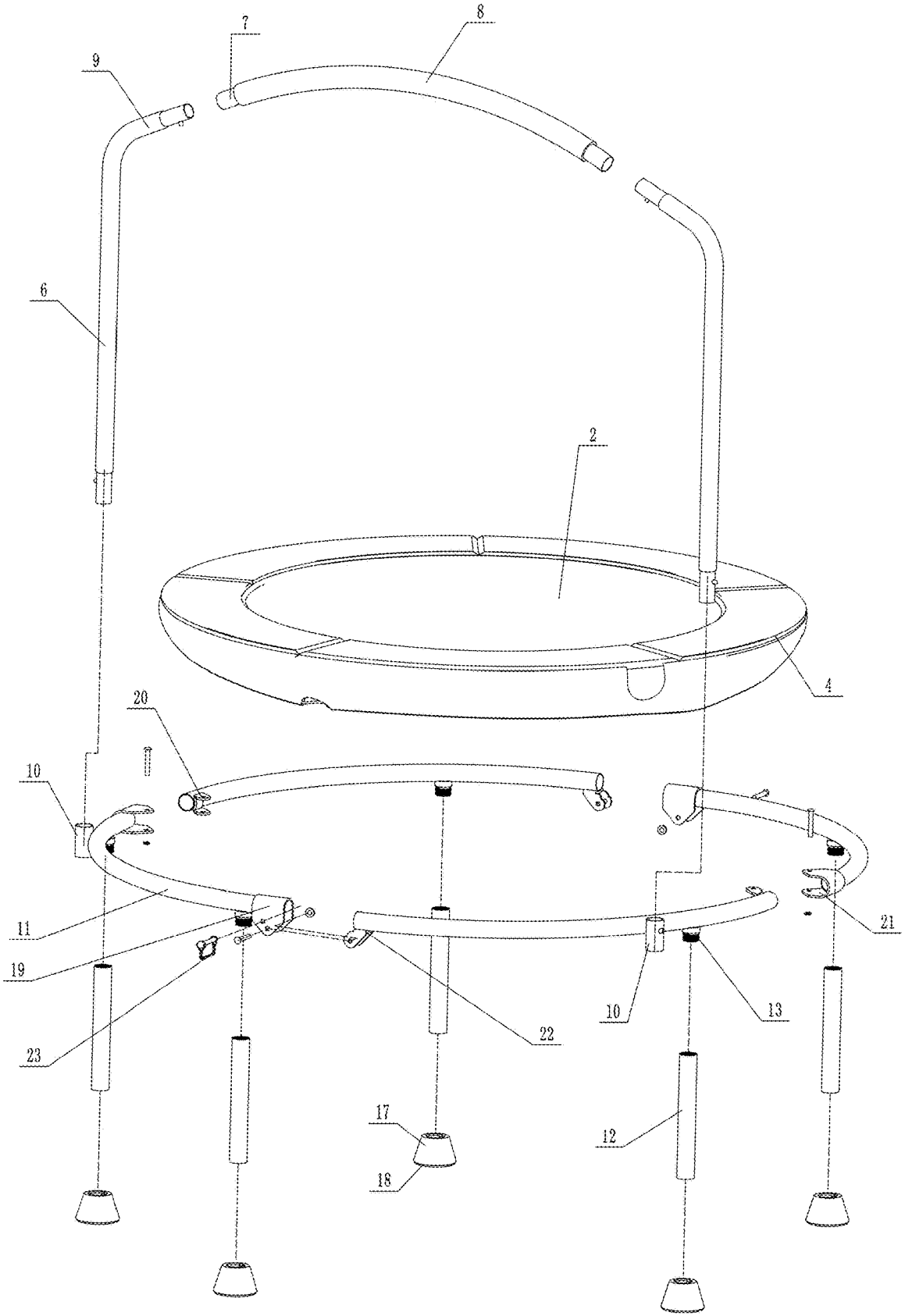
FIG. 2 is an exploded view of the trampoline of FIG. 1, according to one or more embodiments shown and described herein.
Figure 3:
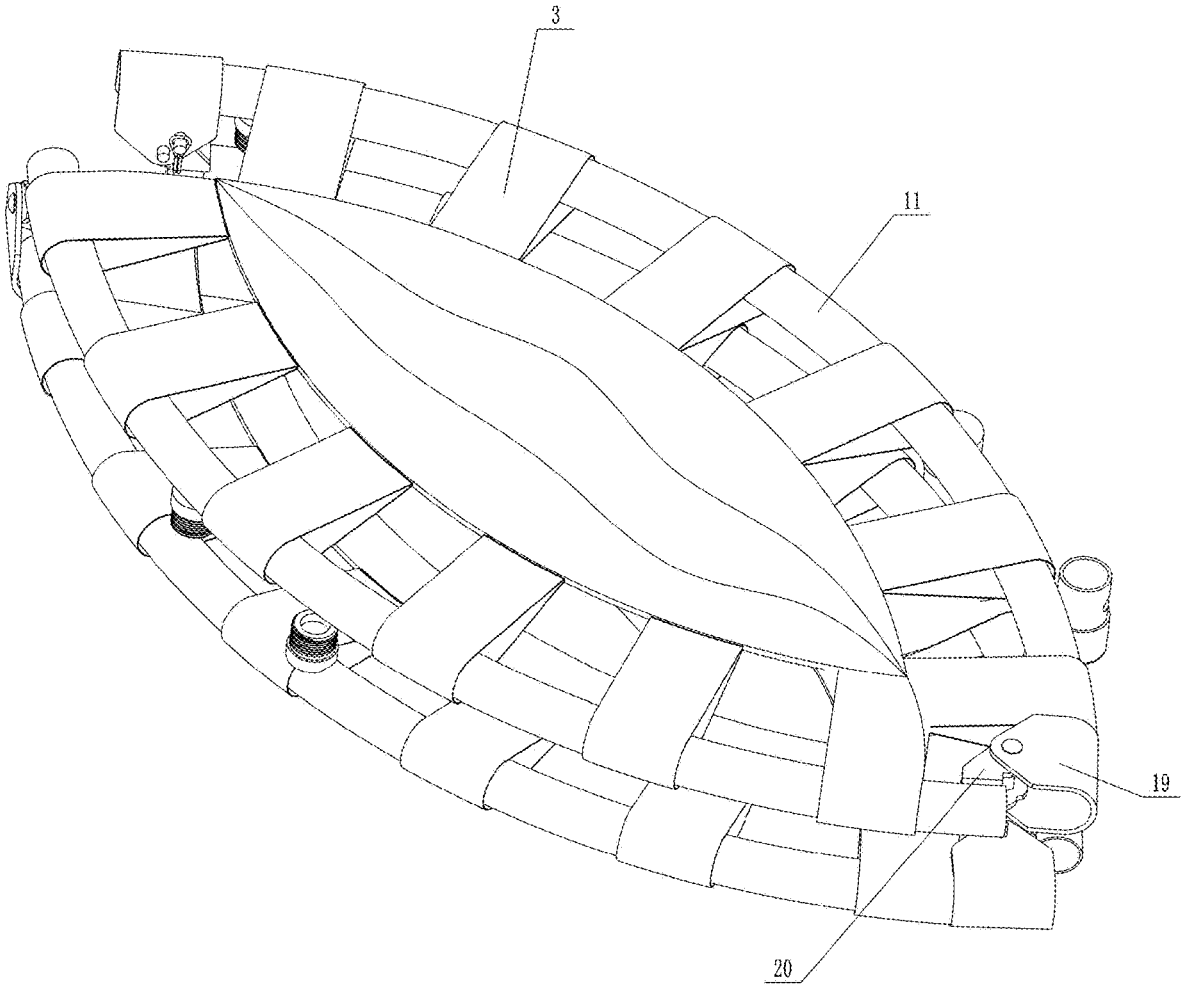
FIG. 3 is a schematic diagram of the trampoline of FIG. 1 after being folded, according to one or more embodiments shown and described herein.
Figure 4:
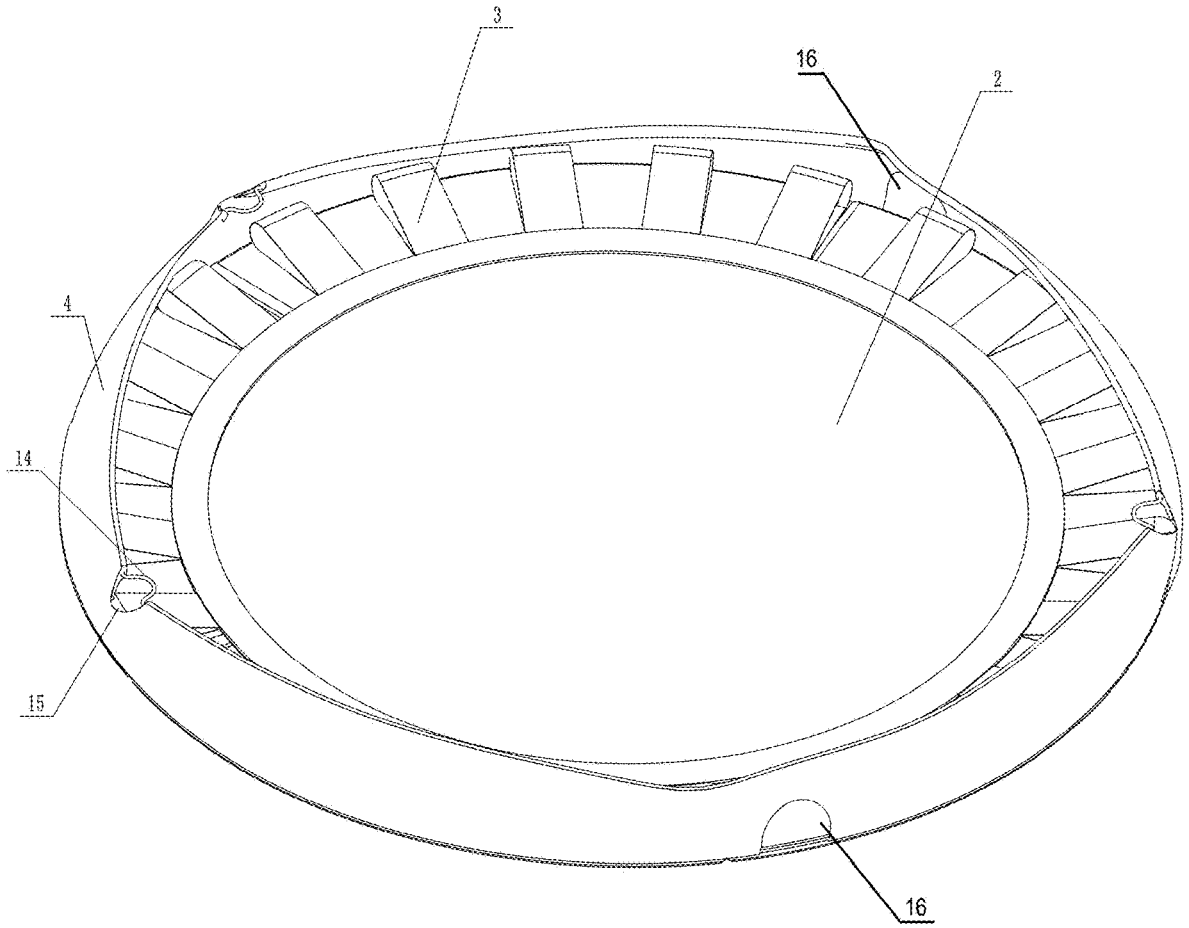
FIG. 4 is a schematic diagram of a connection of a bounce cloth and an enclosing cloth of the trampoline of FIG. 1, according to one or more embodiments shown and described herein.

Referring still to FIGS. 1-4, and as most clearly illustrated in FIG. 2, each of the plurality of pipes 11 may be provided with a joint 13, such as a threaded joint, corresponding to the leg pipe 12, such that the upper end of the leg pipe 12 may be in threaded connection with the joint 13. In these embodiments, a rope 14, such as an elastic rope, may be connected to the outer edge of the enclosing cloth 4, and notches 15 may be provided on an edge of the enclosing cloth 4 at positions corresponding to the leg pipes 12. As further illustrated in FIGS. 1-4, connecting loops may be formed between the notches 15 and the elastic rope 14, and the connecting loops may be in looped connection with the leg pipes 12.

In one aspect, each of the base pipes 11 may have the same general shape and length, and the joints 13 may be disposed at the same location on each of the base pipes 11, such that the joints 13 are generally equally spaced around the trampoline, and the leg pipes 12 are accordingly equally spaced.

As most clearly depicted in FIG. 1, the trampoline frame 1 may further include avoidance holes 16 provided in the enclosing cloth 4 at positions corresponding to the handlebar sleeves 10, with the avoidance holes 16 being configured to facilitate the installation of the plurality stand rods 6 and the plurality of handlebar sleeves 10. In these embodiments, the trampoline frame 1 may also include leg rests 17 installed at lower ends of the leg pipes 12, and non-slip pads 18 may be arranged at the bottoms of the leg rests 17.

Referring again to FIGS. 1-4, a hinge structure may be arranged at a hinged portion of two adjacent pipes of the plurality of base pipes 11, such that the hinge structure comprises a hinge seat 19, such as a U-shaped hinge seat, and a hinge lug 20, such as a U-shaped hinge lug. In these embodiments, the hinge seat 19 and the hinge lug 20 may be hinged with each other by way of a hinge shaft. For example, as depicted most clearly in FIG. 2, two hinge seats 19 (e.g., first hinge seat and second hinge seat) are installed at each end of a subset of the plurality of pipes, such that an opening of at least one hinge seat 19 (e.g., a first hinge seat) faces inward and an opening of the at least one other hinge seat 19 (e.g., a second hinge seat) faces downward. In these embodiments, hinge lugs 20 may be installed at each end of another subset of the plurality of base pipes 11, such that an opening of at least one hinge lug 20 faces inward and an opening of the at least one other hinge lug 20 faces downward. The hinge seat 19 facing inwardly is coupled with the hinge lug 20 faced inwardly, as the hinge seat 19 facing downwardly is coupled with the hinge lug 20 faced downwardly. This type of connection gives more stability to the structure of the trampoline frame 1. As further illustrated in FIG. 2, the hinge seat 19 may be provided with a limiting recess 21 fitting with each of the plurality of base pipes 11, such that, after the plurality of base pipes 11 are unfolded, the pipe 11 to which the hinge lug 20 is connected is clamped in the limiting recess 21 to realize limiting. For example, as provided herein, the limiting recess 21 may restrict movement of the plurality of base pipes 11 once the plurality of base pipes 11 are moved to either the folded position or the unfolded position. In these embodiments, once at least one of the plurality of base pipes 11 is clamped into the limiting recess 21, the hinge structure locks the at least one of the plurality of base pipes 11 in place to ensure the trampoline frame 1 remains stable and does not inadvertently fold or collapse during use.

More particularly, to limit movement of the at least one of the plurality of base pipes, a clamping groove 22 may be provided in the hinge lug 20, a pin 23, such as a spring pin 23, may installed on the hinge seat 19, and after the plurality of base pipes 11 are folded, the spring pin 23 may be clamped in the clamping groove 22 to lock the plurality of base pipes 11 in a folded position.

As further depicted in FIGS. 1-4, it should be appreciated that there may not be a gap between the enclosing cloth 4 and the bounce cloth 2 after the enclosing cloth 4 and the bounce cloth 2 are sewn together, which alleviates the risk of foot trapping during the use of the trampoline. Furthermore, it should be understood that a connection, such as an elastic connection, may be achieved between the bounce cloth 2 and the trampoline frame 1 by means of the elastic bands 3. Accordingly, the elastic connection formed by the elastic bands 3 may have a softness that, alleviates injury risks to a child's body even when the trampoline is utilized for an extended period of time.

Furthermore, in the embodiments described herein, it has been noted that the outer edge of the enclosing cloth 4 may be folded down and wrapped around the periphery of the trampoline frame 1, which not only allows for a reliable connection between the enclosing cloth 4 and the trampoline frame 1, but also wraps the periphery of the trampoline frame 1. Accordingly, by wrapping the periphery of the trampoline frame 1 with the enclosing cloth 4, potential safety hazards may be reduced and the overall aesthetics of the trampoline frame 1 is also improved, as the various joints positions of the trampoline frame 1 may be covered by the enclosing cloth 4.

It should be further noted that, in the embodiments described herein, the handlebar 5 may be installed on the trampoline frame 1 such that the handlebar 5 maybe grasped in the process of bouncing to keep the body stable. The trampoline frame 1 may also be folded, which may aid in minimizing the space the trampoline frame 1 occupies, thereby facilitating storage and carrying. Furthermore, after the trampoline frame 1 is folded, the spring pin 23 installed on the hinge seat 19 may be clamped in the clamping groove 22 in the hinge lug 20 to lock the trampoline frame 1 in the folded position, thereby, preventing potential safety hazards caused by the plurality of base pipes 11 popping out of the folded position. In the embodiments described herein, the support at the bottom of the leg pipe 12 may also provide additional stability of the trampoline frame 1.

Figure 5:
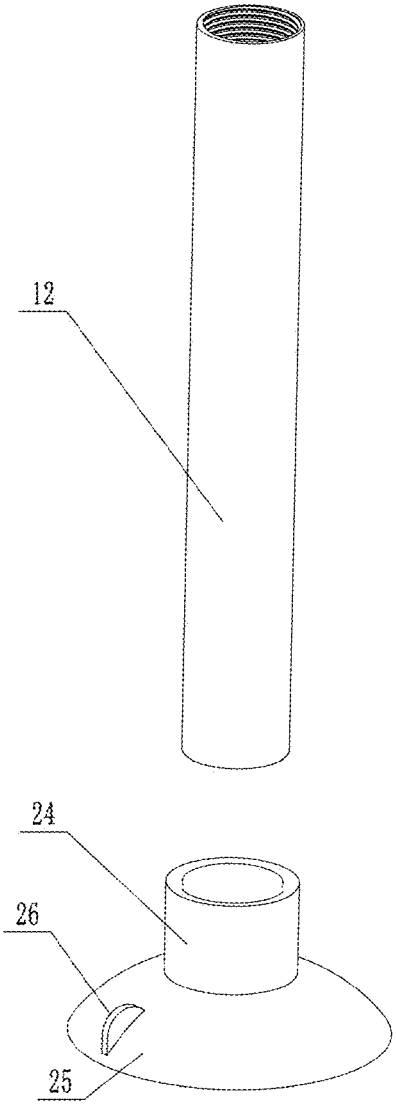
FIG. 5 is an exploded view of a connection of a suction leg rest and a leg pipe of another embodiment of the trampoline of FIG. 1, according to one or more embodiments shown and described herein.

Turning now to FIG. 5, in some embodiments, the trampoline frame 1 may further include suction leg rests 24 installed at lower ends of leg pipes 12. In these embodiments, suction cups 25 may be arranged at the bottoms of the suction leg rests 24, and an outwardly projecting puller 26 may be arranged at an edge of each of the suction cups 25. The suction cup 25 may be provided on the suction leg rest 24, such that the suction cup 25 adheres to the ground via negative pressure to allow a stable support of the leg pipe 12. In the embodiments described herein, when the leg pipe 12 is to be moved, the puller 26 may be pulled upwardly to allow the separation of the suction cup 25 from the ground, such that the leg pipe 12 can be easily moved.

It should be understood that the embodiments as shown in the drawings only show the optional shapes, sizes and arrangements of optional components of the trampoline according to the present disclosure, which are merely illustrative but not restrictive, and other shapes, sizes and arrangements may be employed without departing from the idea and scope of the present disclosure.

The technical contents and technical features of the present disclosure are disclosed above, but it can be understood that those skilled in the art would have made various variations and improvements to the concepts disclosed above under the creative idea of the present disclosure, and all the variations and improvements fall into the scope of protection of the present disclosure. The descriptions of the above embodiments are illustrative but not restrictive, and the scope of protection of the present disclosure is determined by the claims.

PARTS LIST

1: trampoline frame;
2: bounce cloth;
3: elastic band;
4: enclosing cloth;
5: handlebar;
6: stand rod;
7: lateral rod;
8: protective tube;
9: connection section;
10: handlebar sleeve;
11: base pipe;
12: leg pipe;
13: threaded joint;
14: elastic rope;
15: notch;
16: avoidance hole;
17: leg rest;
18: non-slip pad;
19: hinge seat;
20: hinge lug;
21: limiting recess;
22: clamping groove;
23: U-shaped spring pin;
24: suction leg rest;
25: suction cup; and
26: puller.

The invention claimed is:

1. A trampoline comprising:

a trampoline frame having a plurality of base pipes;

a bounce cloth extending across the trampoline frame;

a plurality of elastic bands, springs, or elastic ropes circumferentially connected at intervals between the bounce cloth and the trampoline frame;

an enclosing cloth sewn at an edge of the bounce cloth such that the enclosing cloth covers the plurality of elastic bands, springs, or elastic ropes; and a hinged structure coupled between each of the plurality of base pipes; wherein the plurality of base pipes are movable between a folded position and an unfolded position via the hinged structure;

wherein the hinged structure comprises a hinge seat and a hinge lug, the hinge seat and the hinge lug being hingedly coupled via a hinge shaft, wherein the hinge seat is provided with a limiting recess, and after the plurality of base pipes move to the unfolded position, at least one of the plurality of base pipes to which the hinge lug is connected is clamped in the limiting recess; and wherein a clamping groove is provided in the hinge lug at a proximal end thereof, wherein the clamping groove extends substantially perpendicular to a longitudinal axis of the hinge seat, a spring pin is installed on the hinge seat, and after the plurality of base pipes are moved to the folded position, a spring band of the spring pin is clamped in the clamping groove substantially along the longitudinal axis of the hinge seat to lock the plurality of base pipes in the folded position.

2. The trampoline according to claim 1, wherein a first hinge seat and a second hinge seat of the plurality of hinge seats are installed at each end of a subset of the plurality of base pipes, such that an opening of the first hinge seat faces inward of the trampoline frame and an opening of the second hinge seat faces downward; wherein a first hinge lug and a second hinge lug of the plurality of hinge lugs are installed at each end of another subset of the plurality of base pipes, such that an opening of the first hinge lug faces inward and an opening of the second hinge lug faces downward.

3. The trampoline according to claim 1, further comprising a handlebar mounted on the trampoline frame, wherein the handlebar has an inverted U-shaped structure, and is connected to the trampoline frame at a first end and a second end of the handlebar, wherein the handlebar comprises a plurality of stand rods including at least a first stand rod and a second stand rod, and a lateral rod connected between the first stand rod and the second stand rod.

4. The trampoline according to claim 3, wherein the lateral rod has an arc-shaped structure, wherein an upper end of each of the first stand rod and the second stand rod is bent to form a connection section, and a first end of the lateral rod and a second end of the lateral rod are connected to the connection sections on the first stand rod and the second stand rod in inserted nested manner therebetween and are locked by way of spring button clips.

5. The trampoline according to claim 1, wherein the trampoline frame further comprises a plurality of leg pipes, and upper ends of the plurality of leg pipes are detachably connected to the plurality of base pipes.

6. The trampoline according to claim 5, wherein a rope is connected to the enclosing cloth, notches are provided on the enclosing cloth at positions corresponding to the plurality of leg pipes, connecting loops are formed between the notches and the rope, and the connecting loops are connected to the plurality of leg pipes.

7. The trampoline according to claim 5, wherein a plurality of leg rests are installed at lower ends of each of the plurality of leg pipes, and non-slip pads or suction cups are arranged on each of the plurality of leg rests.

* * * * *